US005486118A

United States Patent [19]

Colleran et al.

[11] Patent Number: 5,486,118

[45] Date of Patent: Jan. 23, 1996

[54] ELECTRICAL CONNECTOR WITH TERMINAL POSITION ASSURANCE DEVICE AND GUIDE MEANS FOR A MATING CONNECTOR

[75] Inventors: Stephen A. Colleran, Lisle; Jeffrey J. Pawlicki, Downers Grove; John O. Higgins, Jr., Berwyn, all of Ill.

[73] Assignee: Molex Incorporated, Lisle, Ill.

[21] Appl. No.: 316,785

[22] Filed: Oct. 3, 1994

[51] Int. Cl.[6] ..... H01R 13/436; H01R 13/629

[52] U.S. Cl. ..... 439/374; 439/752

[58] Field of Search ..... 439/374, 595, 439/752

[56] References Cited

U.S. PATENT DOCUMENTS

| | | | |
|---|---|---|---|
| 4,944,688 | 7/1990 | Lundergan | 439/752 |
| 4,986,758 | 1/1991 | Wakata | 439/374 |
| 5,071,374 | 12/1991 | Plocek et al. | 439/752 |
| 5,080,604 | 1/1992 | Rider et al. | 439/357 |
| 5,100,346 | 3/1992 | McCardell | 439/752 |
| 5,240,433 | 8/1993 | Kato | 439/752 |
| 5,256,084 | 10/1993 | Kodama | 439/752 |
| 5,316,497 | 5/1994 | Topolewski et al. | 439/752 |

*Primary Examiner*—Gary F. Paumen
*Attorney, Agent, or Firm*—A. A. Tirva

[57] ABSTRACT

An electrical connector assembly includes a housing having a forward mating end and a rearward terminating end. A plurality of terminal-receiving cavities extend between the ends. A plurality of terminals are received in the cavities. A TPA device is selectively engageable with the housing at the mating end thereof. The TPA device includes a guide structure for guiding a complementary connecting device into mating engagement with the mating end of the connector housing.

13 Claims, 4 Drawing Sheets

ELECTRICAL CONNECTOR WITH TERMINAL POSITION ASSURANCE DEVICE AND GUIDE MEANS FOR A MATING CONNECTOR

FIELD OF THE INVENTION

This invention generally relates to the art of electrical connectors and, particularly, to an electrical connector which incorporates a single component performing the dual function of a terminal position assurance device and a guide means for a complementary mating connector or other connecting device.

BACKGROUND OF THE INVENTION

Generally, an electrical connector includes a dielectric housing mounting at least one electrically conductive terminal therein. The terminal is electrically connected to another circuit component, such as a discrete wire. Connectors often are employed in mateable pairs such that each terminal and the housing of one connector are mateable with a corresponding terminal and the housing of another connector.

The terminals of electrical connectors frequently are very small components, such as components that are stamped and/or formed from thin sheet metal material. A poor quality electrical connection may occur if one or more terminals are not properly seated in its respective housing. The improper seating of a terminal in a housing may occur if the terminal is not fully inserted into the housing during the initial assembly of the connector or if the terminal is vibrated or pulled out of its fully seated condition during use of the connector. Failures of this type are a particular concern in the automotive industry where electrical components are subjected to vibration almost continuously during normal usage and are subjected to direct force during some maintenance. To avoid these problems, the automotive industry often requires connectors to be provided with some form of a terminal position assurance (TPA) system to detect incomplete insertion of the terminals. The automotive industry also generally requires locking means for locking the terminals in the housing, and a TPA system or device also performs this function.

In addition, in some applications such as the automotive industry, the locations of electrical connectors often make it very difficult to accurately align a pair of mating connectors prior to or during mating. This particularly may be a problem where at least one connector in a mateable pair is mounted to a panel that prevents accurate visual alignment during mating or the connector is in a cumbersome or awkward location. A technician may stop the mating of a pair of connectors in response to resistance generated by improperly aligned connector housings. Consequently, guiding means on one or both of the connectors often is desirable to facilitate either blind mating or mating of the connectors in awkward locations, such as in a glove compartment or behind a dashboard of an automobile.

Still further, automotive headliner assemblies typically include a dome light/switch or a glove compartment light/switch combination which have to be connected to the main electrical harness of an automobile. Presently, this is accomplished by mounting the headliner assembly to a sheet metal portion of the automobile and then utilizing a pigtail portion of the harness extending from the headliner assembly terminated in a connector to mate with a connector terminating a pigtail portion extending from the main electrical harness of the automobile. Once the two connectors are mated, they have to be fastened to the headliner assembly, or else the two mated connectors simply "dangle" by the pigtail portions of the wiring. Such assembly or fastening procedures require the use of both hands by a technician, is time consuming and cumbersome, and the two pigtail connectors require additional mounting space.

The electrical connector system of the present invention solves this wide ranging multitude of problems in a connector assembly wherein one of the connectors is adapted for floatingly mounting to a panel to eliminate the pigtail arrangements, and wherein a single component is used to perform dual functions of providing a TPA device as well as a means for guiding a complementary connector into mating engagement with the mounted connector.

SUMMARY OF THE INVENTION

An object, therefore, of the invention is to provide a new and improved electrical connector with a terminal position assurance device that also guides a complementary connecting device into mating engagement with the connector.

In the exemplary embodiments of the invention, the electrical connector includes a housing having a forward mating end and a rearward terminating end and a plurality of terminal-receiving cavities extending therebetween. A plurality of terminals are received in the cavities. A terminal position assurance (TPA) device is selectively engageable with the housing at the mating end thereof. The TPA device includes guide means for guiding a complementary connecting device into mating engagement with the mating end of the connector housing.

As disclosed herein, the TPA device includes a terminal locking end and a connecting device guiding end. A plurality of spaced apart fingers are provided at the terminal locking end for insertion into the cavities in locking engagement with the terminals. The guide means is provided by a funnel-type structure at the guiding end of the TPA device. The funnel-type structure defines a relatively wide mouth to receive and guide the complementary connecting device into mating engagement with the mating end of the connector housing.

In one embodiment of the invention, the terminal locking end (i.e. the fingers) of the TPA device is arranged generally transverse to the guiding end (i.e. the funnel). In another embodiment, the guiding end (i.e. the funnel) of the TPA device projects generally colinear of the terminal locking end (i.e. the fingers). In still a further embodiment of the invention, the connector housing, itself, includes guide means cooperating with the guide means on the TPA device for guiding the complementary connecting device into mating engagement with the mating end of the connector housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
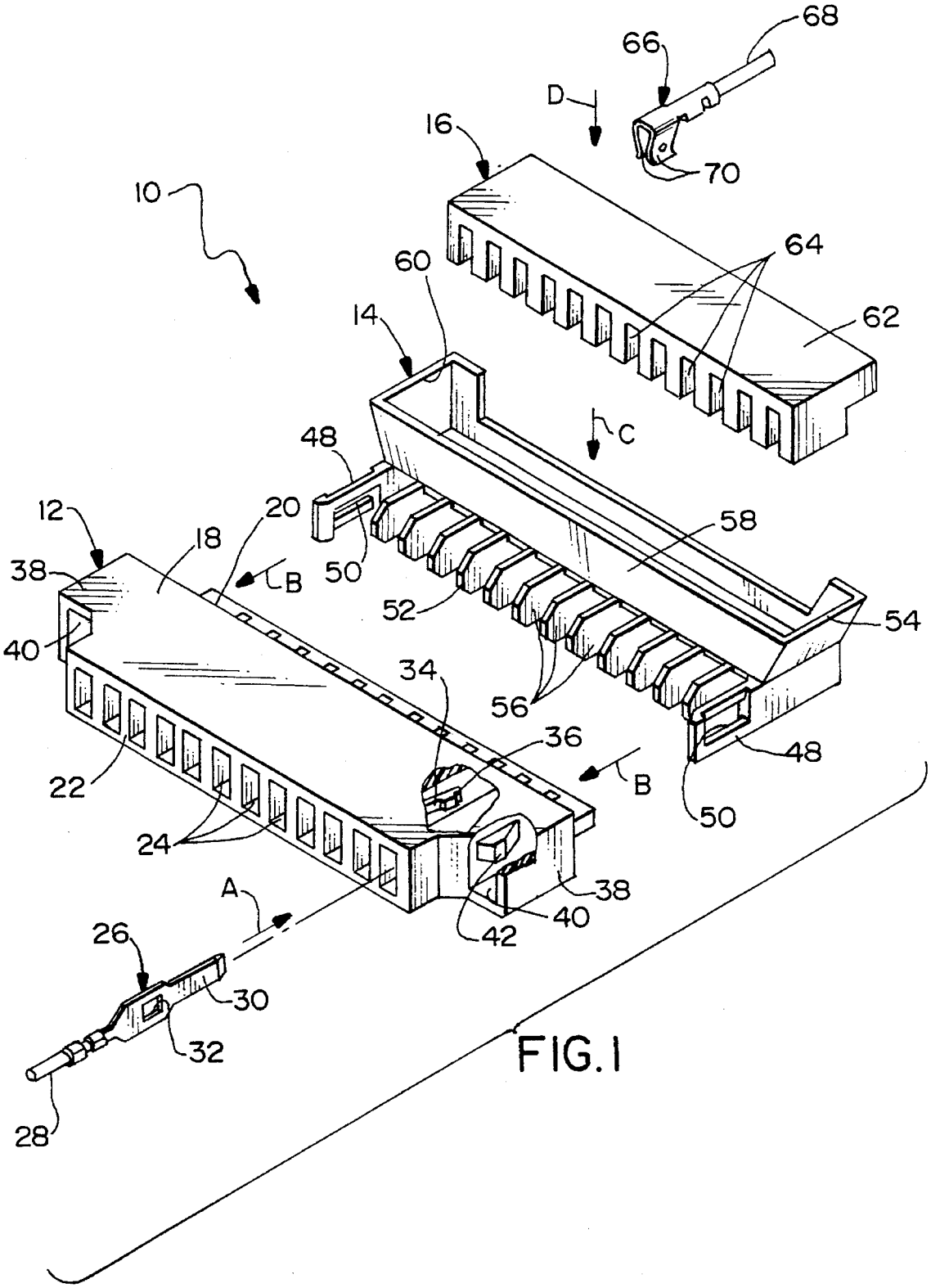
FIG. 1 is an exploded perspective view of an electrical connector assembly incorporating the concepts of the invention.

Referring to the drawings in greater detail, and first to FIG. 1, the invention is embodied in an electrical connector assembly, generally designated 10, which includes an electrical connector, generally designated 12, which is adapted for floatingly mounting to a panel or the like, as described hereinafter. The connector assembly includes a terminal position assurance (TPA) device, generally designated 14, for assembly to connector 12 and for guiding a complementary connecting device or mating connector, generally designated 16, into mating engagement with mounted connector 12. Therefore, hereinafter connector 12 will be referred to as the "mounted connector" and connector 16 will be referred to as the "mating connector".

Mounted connector 12 includes a dielectric housing 18 defining a forward mating end 20 and a rearward terminating end 22. A plurality of terminal-receiving cavities 24 extend through the housing between forward mating end 20 and rearward terminating end 22. Although only one terminal is shown in FIG. 1, a plurality of terminals, generally designated 26, are inserted into cavities 24 from terminating end 22 in the direction of arrow "A". Each terminal is terminated to a discrete electrical cable or wire 28. Each terminal is a male terminal and is stamped and formed of sheet metal material to define a forwardly projecting male or blade portion 30.

Means are provided for locking terminals 26 within terminal-receiving cavities 24 of connector housing 18. In particular, each terminal is stamped with a locking aperture 32. Each cavity 24 includes a flexible locking arm 34 having a locking boss 36 that snappingly engages within locking aperture 32 of the terminal when the terminal is inserted into its respective cavity 24 in the direction of arrow "A".

Lastly in referring to mounted connector 12 in FIG. 1, housing 18 includes a pair of wing portions 38 that define passages 40 within which ramped latching bosses 42 are formed for purposes to be described hereinafter. Housing 18 is unitarily molded of dielectric material such as plastic or the like, such that locking arms 34, locking bosses 36, wing portions 38 and latching bosses 42 all are formed integrally with the housing.

Figure 2:
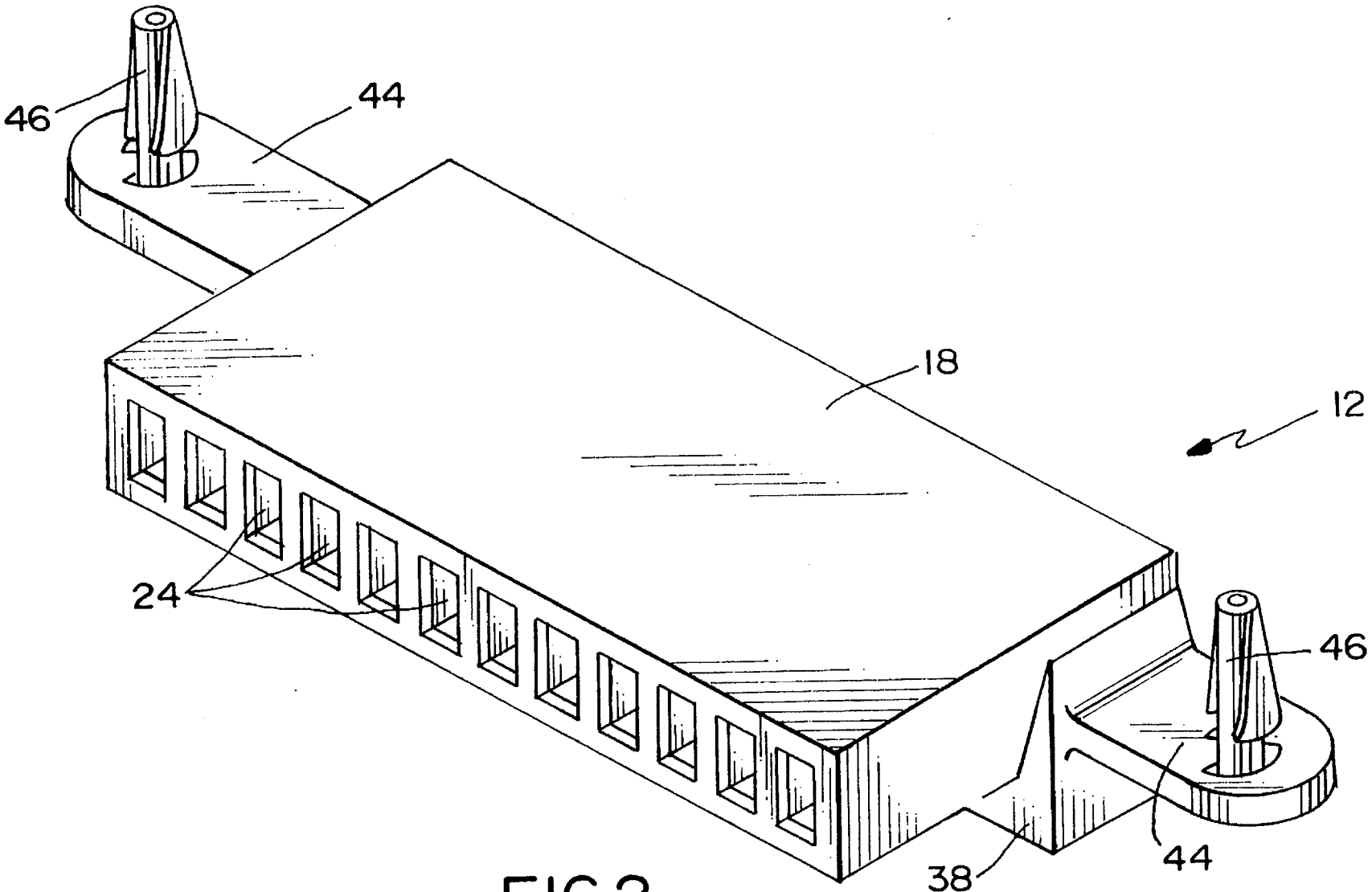
FIG. 2 is a bottom perspective view of the panel mountable connector.

Referring to FIG. 2 in conjunction with FIG. 1, mounted connector 12 includes a pair of side flanges 44 from which a pair of spiralled floating mounting posts 46 project. FIG. 2 is a bottom perspective view of mounted connector 12 in comparison to FIG. 1 which shows a top perspective view of the connector. Mounting posts 46 are adapted for insertion into appropriate mounting holes in a panel or the like to floatingly mount connector 12 to the panel.

Referring back to FIG. 1, TPA device 14 is unitarily molded of dielectric material, such as plastic or the like, and includes a pair of flexible latching arms 48 at each end thereof. The latching arms are constructed for insertion into passages 40 of connector housing 18 in the direction of arrows "B". During assembly, the resilient latching arms spread apart in response to engagement with ramped latching bosses 42 and, upon full assembly, latching apertures 50 snap into latching engagement about bosses 42.

In essence, TPA device 14 defines a terminal locking end 52 and a mating connector guiding end 54. The terminal locking end is defined by a plurality of spaced apart fingers 56 which are inserted into terminal-receiving cavities 24 of mounted connector 12 when the TPA device is assembled to the connector. The fingers are effective for engaging terminal blades 30 on sides thereof opposite flexible locking arms 34. In other words, fingers 56 are effective for holding the terminals into locked position within cavities 24. If, for some reason, a particular terminal has not been fully inserted whereby locking aperture 32 in the terminal does not snap around locking boss 36 of the respective locking arm 34, the terminal ends up blocking the respective cavity, and the respective finger 56 of the TPA device will not be able to move into that cavity, resulting in the TPA device not being capable of assembly to the mounted connector. This gives a ready indication to a technician that at least one terminal is improperly or incompletely positioned. Of course, as explained above, if all of the terminals are properly positioned, the TPA device is effective as a secondary locking means to lock all of the terminals in their locked condition.

Mating connector guiding end 54 of TPA device 14 includes a guide means defined by an outwardly diverging funnel-type structure 58. The funnel defines a relatively wide mouth 60 to receive and guide mating connector 16 in the direction of arrow "C" into mating engagement with mating end 20 of mounted connector housing 18. In essence, mouth 60 of funnel 58 is wider or larger than the dimensions of mating connector 16 to facilitate guiding the mating connector into proper mating condition with mounted connector 12.

Mating connector 16 includes a dielectric housing 62 defining a plurality of terminal-receiving passages 64 for receiving a plurality of terminals, generally designated 66. Only one terminal is shown in FIG. 1, but the terminals are terminated to discrete electrical wires or cables 68. Terminals 66 are stamped and formed components which define a female terminal having a bifurcated female end 70 which will engage blade portions 30 of male terminals 26 when mating connector 16 is assembled to TPA device 14 in the direction of arrow "C", whereupon female terminals 66 will mate with blade portions 30 of male terminals 26 in the direction of arrow "D".

Figure 3:
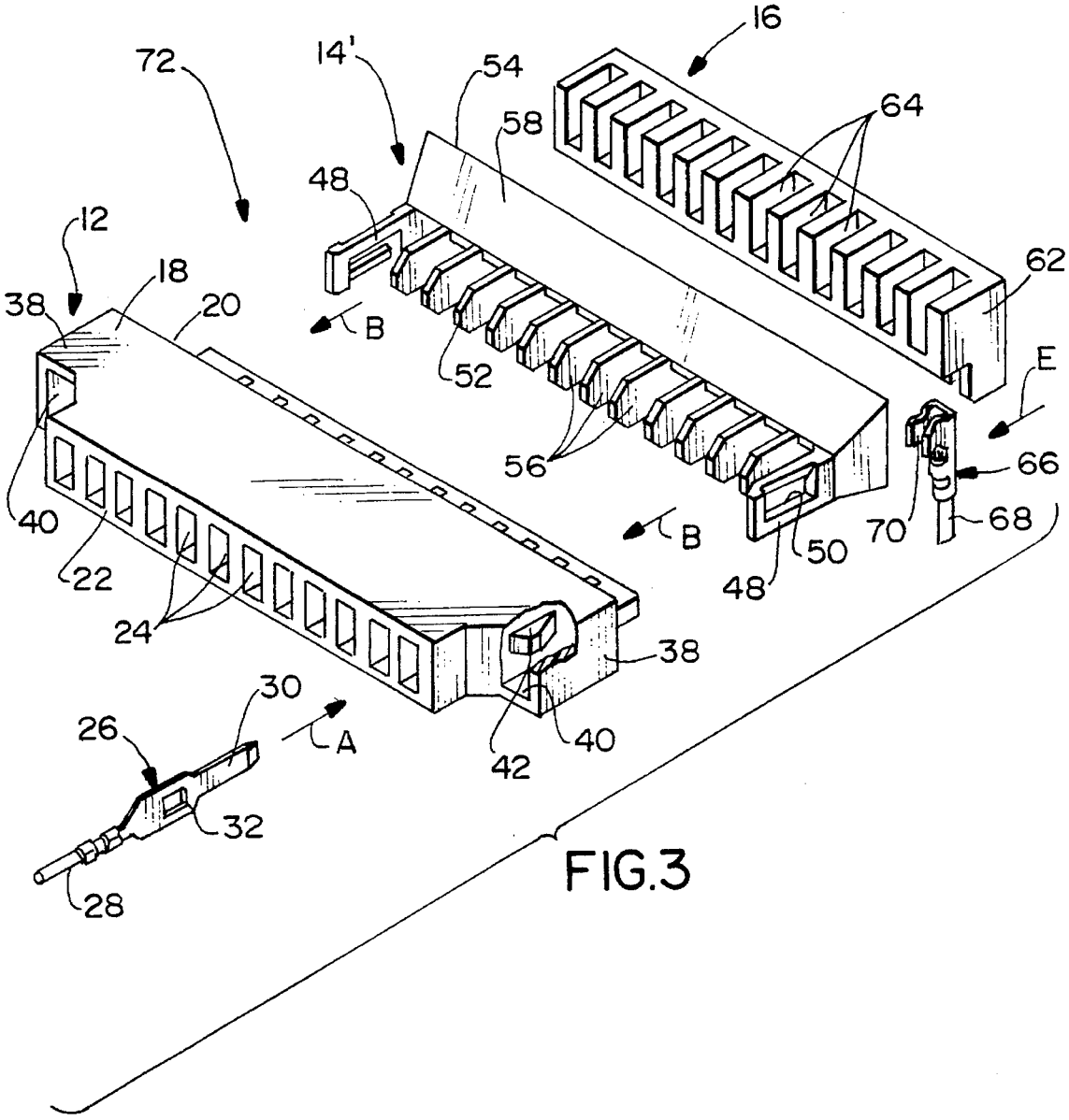
FIG. 3 is an exploded perspective view similar to that of FIG. 1, but of a second embodiment of a connector assembly incorporating the concepts of the invention.

FIG. 3 shows a second embodiment of a connector assembly, generally designated 72, which is similar to connector assembly 10 (FIG. 1) except for the orientation of the mating connector guiding end of the TPA device. Otherwise, the components of connector assembly 72 function and operate similar to the components of connector assembly 10. Consequently, like reference numerals have been applied in FIG. 3 corresponding to like elements shown in FIG. 1 and described above.

More particularly, a TPA device 14' in FIG. 3 again has a guiding end 54 defined by a funnel-type structure 58. The only difference between TPA device 14' in FIG. 3 and TPA device 14 in FIG. 1, is that funnel 58 of TPA device 14' projects generally colinear with fingers 56 at the terminal locking end 52 of the device. This is in contrast to the relative transverse orientation of funnel 58 and fingers 56 of TPA device 14 in FIG. 1. As a result, mating connector 16 and female terminals 66 are oriented in the embodiment of FIG. 3 for assembly to TPA device 14' and for mating with mounted connector 12 in the direction of arrow "E" (FIG. 3).

Figure 4:
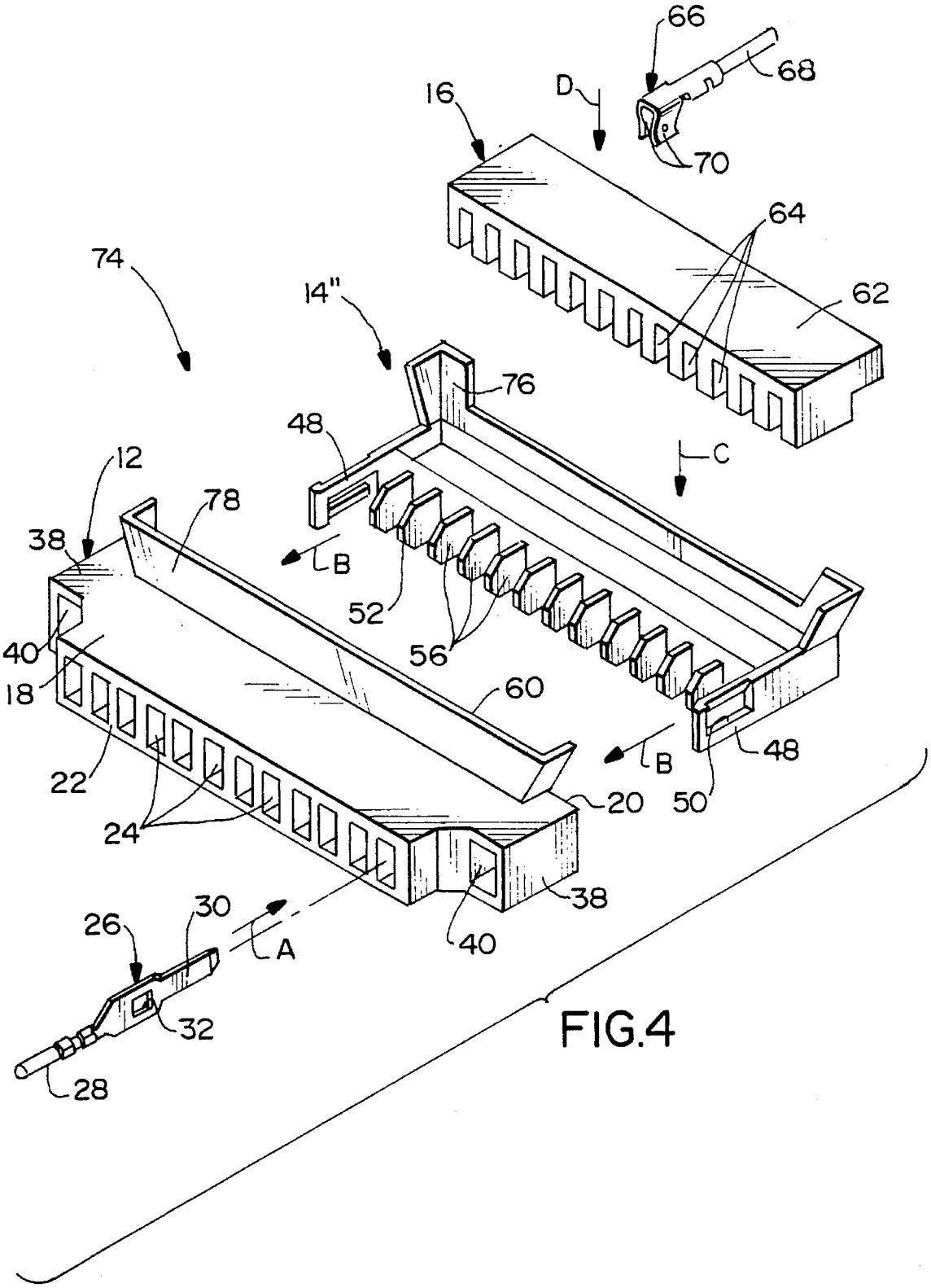
FIG. 4 is an exploded perspective view similar to that of FIGS. 1 and 3, but of a third embodiment of a connector assembly incorporating the concepts of the invention.

FIG. 4 shows a third embodiment of a connector assembly, generally designated 74, which includes a mounted connector with a housing that also includes guide means for cooperating with the guide means on the TPA device for guiding mating connector 16 into mating engagement with the mating end of the mounted connector. Otherwise, again, connector assembly 74 is constructed and functions very similar to connector assemblies 10 and 72, particularly connector assembly 10. Consequently, like reference numerals have been applied in FIG. 4 corresponding to like elements shown in FIGS. 1 and 3 and described above.

More particularly, a TPA device 14" of connector assembly 74 (FIG. 4) includes a funnel structure 76 that cooperates with a funnel structure 78 on housing 18 of mounted connector 12. In essence, as can be seen in FIG. 4, one-half of the complete funnel-like structure 58 of the embodiment in FIG. 1 is located on TPA device 14' and the other one-half of the funnel-like structure is located on mounted connector 12. The result of this configuration is to shorten the dimensions of the TPA device, and this can be clearly understood by comparing terminal locking fingers 56 in the embodiment of FIG. 4 with the fingers in FIGS. 1 and 3. It can be seen that the fingers in the embodiment of FIG. 4 are shorter than the fingers of either of the embodiments in FIGS. 1 or 3. This is the result of forming one-half of the guiding funnel on the TPA device and the other one-half of the guiding structure on the housing of the mounted connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector assembly, comprising:

a housing having a forward mating end and a rearward terminating end and a plurality of terminal-receiving cavities extending therebetween;

a plurality of terminals received in said cavities; and a TPA device selectively engageable with the housing at said mating end thereof, the TPA device having guide means for guiding a complementary connecting device into mating engagement with the mating end of the connector housing; and wherein said guide means comprises a funnel-type structure defining a relatively wide mouth to receive and guide the complementary connecting device into mating engagement with the mating end of the connector housing.

2. The electrical connector assembly of claim 1 wherein said TPA device includes a plurality of spaced apart fingers for insertion into the cavities in locking engagement with the terminals.

3. The electrical connector assembly of claim 1 wherein said TPA device has a terminal locking end and a connecting device guiding end.

4. The electrical connector assembly of claim 3, including a plurality of spaced apart fingers at the terminal locking end of the TPA device for insertion into the cavities in locking engagement with the terminals.

5. The electrical connector assembly of claim 1 wherein said fingers project generally transverse to said funnel-type structure.

6. The electrical connector assembly of claim 1 wherein said fingers project generally colinear of said funnel-type structure.

7. The electrical connector assembly of claim 3 wherein said guiding end of the TPA device projects generally transverse to said terminal locking end thereof.

8. The electrical connector assembly of claim 3 wherein said guiding end of the TPA device projects generally colinear of said terminal locking end thereof.

9. The electrical connector assembly of claim 1 wherein said housing also includes guide means cooperating with the guide means on the TPA device for guiding the complementary connecting device into mating engagement with the mating end of the connector housing.

10. The electrical connector assembly of claim 1 wherein said housing includes floating panel mount means for mounting the connector to a panel.

11. An electrical connector assembly, comprising:

a housing having a forward mating end and a rearward terminating end and a plurality of terminal-receiving cavities extending therebetween;

a plurality of terminals received in said cavities; and a TPA device selectively engageable with the housing at said mating end thereof, the TPA device having a terminal locking end and a connecting device guiding end, the terminal locking end including a plurality of spaced apart fingers for insertion into the cavities in locking engagement with the terminals, the guiding end including a funnel-type structure defining a relatively wide mouth to receive and guide a complementary connecting device into mating engagement with the mating end of the connector housing, said fingers projecting generally transverse to said funnel-type structure.

12. The electrical connector assembly of claim 11 wherein said funnel-type structure on the TPA device comprises one-half of a funnel and said housing includes the other one-half of the funnel.

13. An electrical connector assembly, comprising:

a housing having a forward mating end and a rearward terminating end and a plurality of terminal-receiving cavities extending therebetween;

a plurality of terminals received in said cavities; and a TPA device selectively engageable with the housing at said mating end thereof, the TPA device having a terminal locking end and a connecting device guiding end, the terminal locking end including a plurality of spaced apart fingers for insertion into the cavities in locking engagement with the terminals, the guiding end including a funnel-type structure defining a relatively wide mouth to receive and guide a complementary connecting device into mating engagement with the mating end of the connector housing, said fingers projecting generally colinear of said funnel-type structure.

* * * * *